US008910434B2

(12) United States Patent
Zirbel et al.

(10) Patent No.: US 8,910,434 B2
(45) Date of Patent: Dec. 16, 2014

(54) PRE-CAST MONOLITHIC CONCRETE STAIR WITH DUAL EDGE BEAMS, METHOD AND MOLD

(75) Inventors: Mark E. Zirbel, Conyers, GA (US); Bryant A. Zavitz, Dunwoody, GA (US)

(73) Assignee: Metromont Corporation, Greenville, SC (US)

( * ) Notice: Subject to any disclaimer, the term of this patent is extended or adjusted under 35 U.S.C. 154(b) by 1058 days.

(21) Appl. No.: 11/943,954

(22) Filed: Nov. 21, 2007

(65) Prior Publication Data

US 2008/0115429 A1 May 22, 2008

Related U.S. Application Data

(60) Provisional application No. 60/866,686, filed on Nov. 21, 2006.

(51) Int. Cl.

| | |
|---|---|
| ***E04F 11/00*** | (2006.01) |
| ***B28B 7/22*** | (2006.01) |
| ***E04F 11/02*** | (2006.01) |
| ***E04F 11/116*** | (2006.01) |

(52) U.S. Cl.

CPC ..... *B28B 7/225* (2013.01); *E04F 11/02* (2013.01); *E04F 11/116* (2013.01)

USPC ..... 52/189; 52/182; 52/190

(58) Field of Classification Search

USPC ..... 52/182, 190, 189

See application file for complete search history.

(56) References Cited

U.S. PATENT DOCUMENTS 875,113 A * 12/1907 Schachner ..... 52/190
1,388,329 A * 8/1921 Davis ..... 52/190
1,475,777 A * 11/1923 Ballenger ..... 52/189
1,566,042 A * 12/1925 Schmidt ..... 52/182
2,239,428 A * 4/1941 Michaud et al. ..... 52/190
2,615,325 A * 10/1952 Seeber ..... 52/190
2,971,238 A * 2/1961 Forssell ..... 264/162
3,007,283 A * 11/1961 Holland ..... 52/190
3,025,639 A * 3/1962 Lemieux ..... 52/189
3,055,146 A * 9/1962 Lobato ..... 52/190
3,144,118 A * 8/1964 Fabula ..... 198/332
3,358,969 A * 12/1967 Horgan, Jr. et al. ..... 256/24
3,405,486 A * 10/1968 Fagenstrom ..... 52/190
3,552,084 A * 1/1971 Cormier ..... 52/181
3,762,115 A * 10/1973 McCaul et al. ..... 52/236.6
3,805,461 A * 4/1974 Jagoda ..... 52/79.11
3,805,464 A * 4/1974 Hanson ..... 52/190

(Continued)

*Primary Examiner* — Brian Glessner

*Assistant Examiner* — Joshua Ihezie

(74) *Attorney, Agent, or Firm* — Monahan & Company, LLC; Timothy J. Monahan

(57) ABSTRACT

Pre-cast concrete stairs, molds for making pre-cast concrete stairs, and methods of casting pre-cast concrete stairs are provided. The stair is constructed with two beams that are cast with the stair steps as an integral monolithic structure. One of the beams (integral down edge beam) projects below the steps on one side, and the other (integral up edge beam) projects above the steps on the other side. The weight of the stairs and the weight of traffic on the steps creates compression on the tops of the integral down edge beam and integral up edge beam, and tension on the bottoms of the integral down edge beam and integral up edge beam, which enhances the combined strength of the beams. The asymmetric orientation of the members creates a stronger cross-section than if the beams were in the same plane horizontally, allowing greater load handing capability. Lightweight steps are suspended between the two beams.

6 Claims, 8 Drawing Sheets

(56) References Cited

U.S. PATENT DOCUMENTS

| | | | | | |
|---|---|---|---|---|---|
| 3,818,660 | A | * | 6/1974 | Dillon | 52/251 |
| 3,836,109 | A | * | 9/1974 | Lister | 249/14 |
| 3,914,912 | A | | 10/1975 | Rosenberg | |
| 3,981,112 | A | * | 9/1976 | Dake | 52/184 |
| 4,250,672 | A | * | 2/1981 | Seegers et al. | 52/182 |
| 4,586,585 | A | * | 5/1986 | Zaner | 182/97 |
| 4,646,490 | A | * | 3/1987 | Naka et al. | 52/184 |
| 4,893,442 | A | | 1/1990 | Graham et al. | |
| 4,939,876 | A | * | 7/1990 | Berner | 52/64 |
| 4,995,205 | A | | 2/1991 | Bennett | |
| 5,014,475 | A | * | 5/1991 | Anderson et al. | 52/191 |
| 5,203,128 | A | * | 4/1993 | Bennett | 52/189 |
| 5,309,687 | A | | 5/1994 | Walston | |
| 5,448,862 | A | * | 9/1995 | Candiracci | 52/182 |
| 5,493,823 | A | * | 2/1996 | Baldi | 52/191 |
| 5,511,347 | A | | 4/1996 | Schwarz | |
| 5,531,048 | A | * | 7/1996 | Darling | 52/188 |
| 5,632,124 | A | * | 5/1997 | Weingarten et al. | 52/187 |
| 5,660,892 | A | * | 8/1997 | Robbins et al. | 427/537 |
| 6,029,408 | A | * | 2/2000 | Cavaness | 52/188 |
| 6,035,591 | A | * | 3/2000 | Hicks et al. | 52/181 |
| 6,125,598 | A | * | 10/2000 | Lanphier | 52/182 |
| 6,209,854 | B1 | * | 4/2001 | Sedlack et al. | 256/59 |
| 6,959,521 | B1 | * | 11/2005 | Brooks | 52/745.05 |
| 2006/0150550 | A1 | * | 7/2006 | Summers | 52/270 |
| 2006/0230693 | A1 | * | 10/2006 | Giordano | 52/182 |

* cited by examiner

PRE-CAST MONOLITHIC CONCRETE STAIR WITH DUAL EDGE BEAMS, METHOD AND MOLD

CROSS REFERENCE TO RELATED APPLICATION

This application claims the benefit of and priority to U.S. Patent Application Ser. No. 60/866,686, filed on Nov. 21, 2006, entitled "EDGE BEAM STAIR" which is incorporated herein by reference.

TECHNICAL FIELD

This invention relates to a concrete stair that is pre-cast, an adjustable mold for casting stairs of different widths, and a method of casting such stairs.

BACKGROUND OF THE INVENTION

Conventional pre-cast concrete stairs exhibit a number of disadvantages. Very often, such stairs are constructed in a form or mold that has a step-shaped bottom surface for defining the steps and an open upper end into which the concrete is poured. This form creates a stair that has a heavy flat slab along its bottom surface. Such a stair requires unnecessarily large amounts of concrete and is quite heavy. It requires a large crane to lift the stair into place. It is challenging to workers to place the heavy stair into the stairwell. Transportation of such stairs to the construction site is also expensive because of the limited number of stairs that can be transported on one truck. The landings or other support structures for holding these pre-cast stairs in position also have to be made stronger because of the weight of the stairs. This requires more concrete or other type of reinforcement material to support the stairs than is desirable.

One of the most common uses of concrete stairs is in the stairwells of large buildings to provide a fire escape. Building owners want to keep these stairs as narrow as possible to limit the size of the stairwell, which is nonproductive space. This is difficult because of the requirement that the stairs have rails.

Because of different building requirements and designs, stairs of different step widths are frequently required to be cast. The present forms for pre-casting concrete stairs cannot be adjusted to match varying widths of the stairs. A completely new form is required for each variation in stair width, which adds to the cost of casting stairs.

Concrete stairs can be cast in several sections and then put together at the building site. However, this approach suffers from the disadvantage of being highly labor intensive.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Figure 1A:
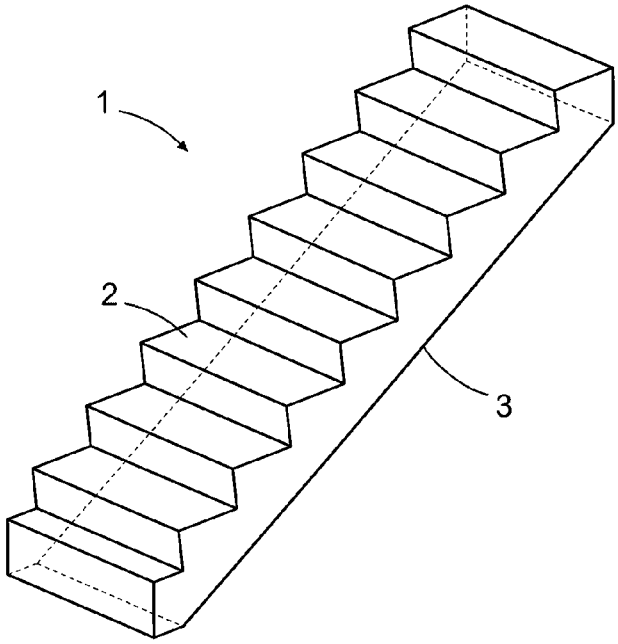
(PRIOR ART) FIG. 1A
FIG. 1A is a perspective view of the top and side of a prior art pre-cast stair.

Prior art pre-cast concrete stairs are heavy structures because the structural support is in the steps themselves which must not have any point that is weaker than what is necessary to support the entire stair. The stair itself is the beam and like any beam must have the same strength throughout its entire length, including all sections of each step. This results in the use of a lot more concrete and reinforcing material than would be required in just the steps to support the human traffic. The massive size of the prior art stair is visually apparent in FIGS. 1A and 1B, in which the stair 1 has steps 2 and an underside 3.

This invention provides a lightweight pre-cast concrete stair, ideally suited for use as the fire stairs in a multi-story building. This stair is constructed with two beams that are cast with the stair steps as an integral monolithic structure. One of the beams, the integral down edge beam, projects below the steps on one side of the stair and does not impinge upon the width of the steps. The steps on this side of the stair serve as the top of the beam. This integral down edge beam is designed to be placed against a wall of the stairwell. The second beam, an integral up edge beam, projects above and to the side of the steps and is located on the other side of the stair. Lightweight steps are suspended between these two beams. These steps can be constructed with much less concrete and are consequently much lighter than the steps of prior art concrete stairs because the steps do not serve as a beam. The weight of the stairs, including traffic on the steps, creates compression on the tops of the integral down edge beam and integral up edge beam, and tension on the bottoms of the integral down edge beam and integral up edge beam, which enhances the combined strength of the beams. The asymmetric orientation of the members creates a stronger cross-section than if the beams were in the same plane horizontally, allowing greater load handing capability. Stairs of this type require significantly less concrete than a prior art stair to handle the same load conditions. An unusually strong lightweight stair can be pre-cast using the molds and methods of this invention. This use of a tension beam as an integral up edge beam and a compression beam as an integral down edge beam enables the saving of 45 to 50% of the concrete needed to construct a prior art concrete stair of the same size.

Because of different size and design parameters of buildings and the fact that builders want to conserve the space dedicated to a stairwell in a building, stairs of different widths are frequently required. In the past it was necessary to have a different form for every width of stair. This invention provides an adjustable mold for pre-casting these monolithic stairs of varying widths. The width of the mold for the stairs can be easily adjusted to cast stairs of varying widths. A new method is provided for casting the monolithic stair of this invention in different widths without changing forms.

One other problem involved in casting stairs is the mistakes involved in laying out the reinforcing rods in the mold. The mold of this invention can be provided with hooks or other means to locate and hold the reinforcing rods in proper position during the pouring of concrete, which makes it much more difficult to make a mistake. A mistake in laying out the reinforcing rods could compromise the strength of the stairs.

Figure 2A:
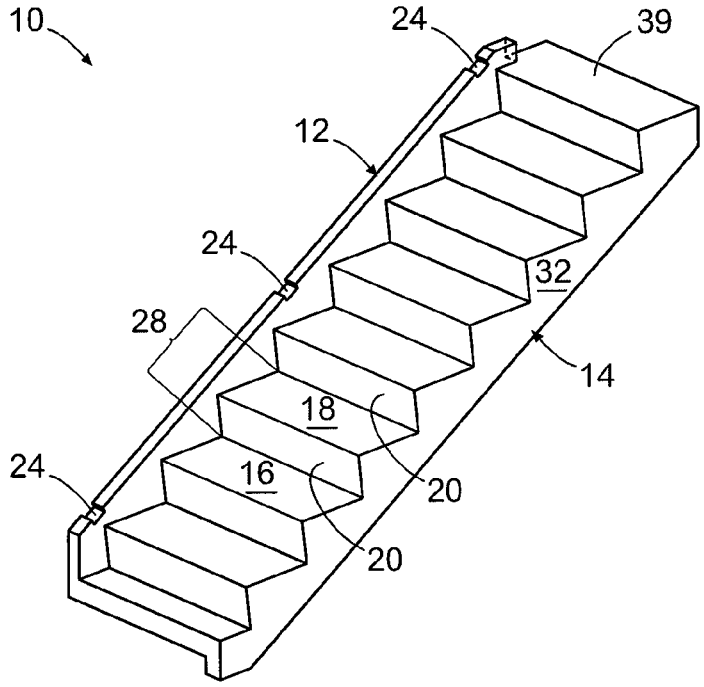
FIG. 2A is a perspective view of the top and side of the pre-cast stair of this invention.
Figure 2B:
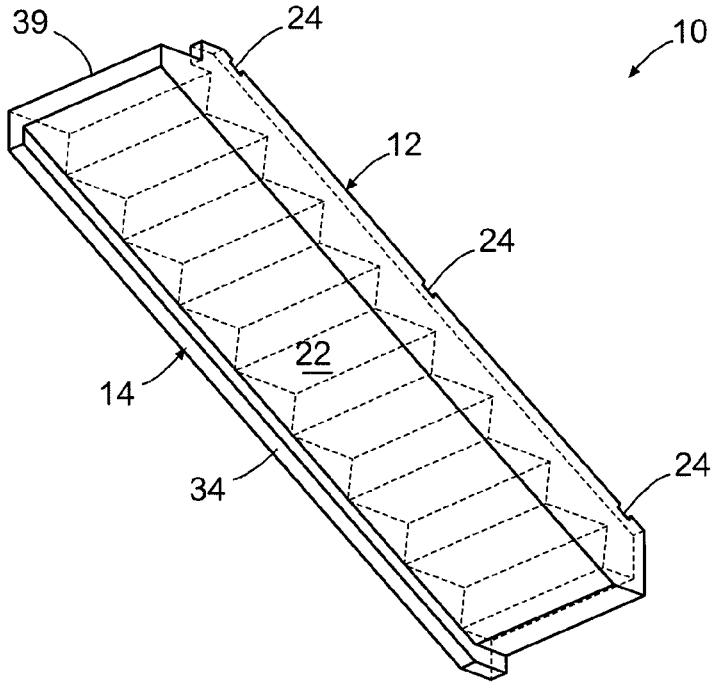
FIG. 2B is a perspective view of the stair of FIG. 2B showing the underside of the stair.

The stair of this invention is illustrated in FIGS. 2A and 2B. This pre-cast concrete stair 10 has an integral up edge beam 12 and an integral down edge beam 14 as shown in FIGS. 2A and 2B. The stair 10 has treads, illustrated by numerals 16 and 18, and risers illustrated by the numeral 20. Tread 18 and riser 20 make a step 28 of the stair 10.

FIG. 2B is a perspective view of the underside 22 of the stair shown in FIG. 2A. The underside 22 is flat and in the same plane from the top to the bottom of the stair 10 except for the integral down edge beam 14. The bottom 34 of the down edge beam 14 projects below the plane of the underside 22 of the stair 10. The underside 22 of the stair 10 is basically flat and does not follow the zigzag configuration of the tread 16 and riser 18 of the stair.

The stair 10 of this invention is designed for the placement of the stair 10 with the integral down edge beam 14 adjacent to a wall. Since portions of the treads 16 and 18 and risers 20 on this side 32 of the steps 28 of the stair 10 form the top of beam 14, this placement allows for more tread room on the stair 10. This allows for people to have more room to walk on the stair. This is especially important in the evacuation of a building during an emergency, such as a fire. There obviously would be less stair room if the integral up edge beam 12 were placed against the wall. The integral up edge beam 12 prevents items from rolling off of the stairs and hitting people below.

This stair 10 may have a handrail. Cuts may be provided in the top 24 of the integral up edge beam 12 for the attachment of a handrail (not shown). Cast-in nosing can be provided with groves to help prevent people's feet from slipping on the stair.

Figure 3A:
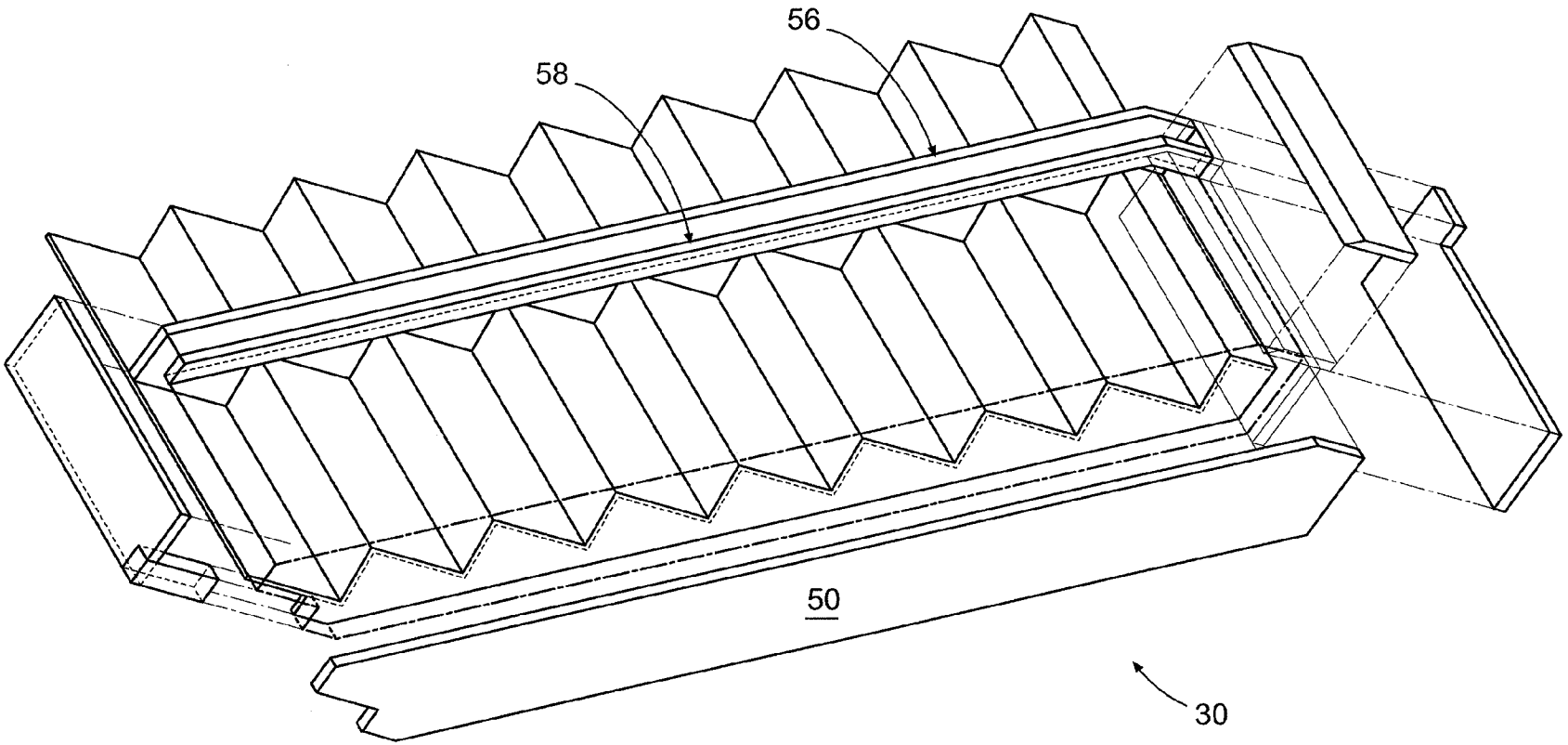
FIG. 3A is an exploded view from the top of the adjustable pre-casting mold of this invention showing the step forms, sides and ends of the mold.
Figure 3B:
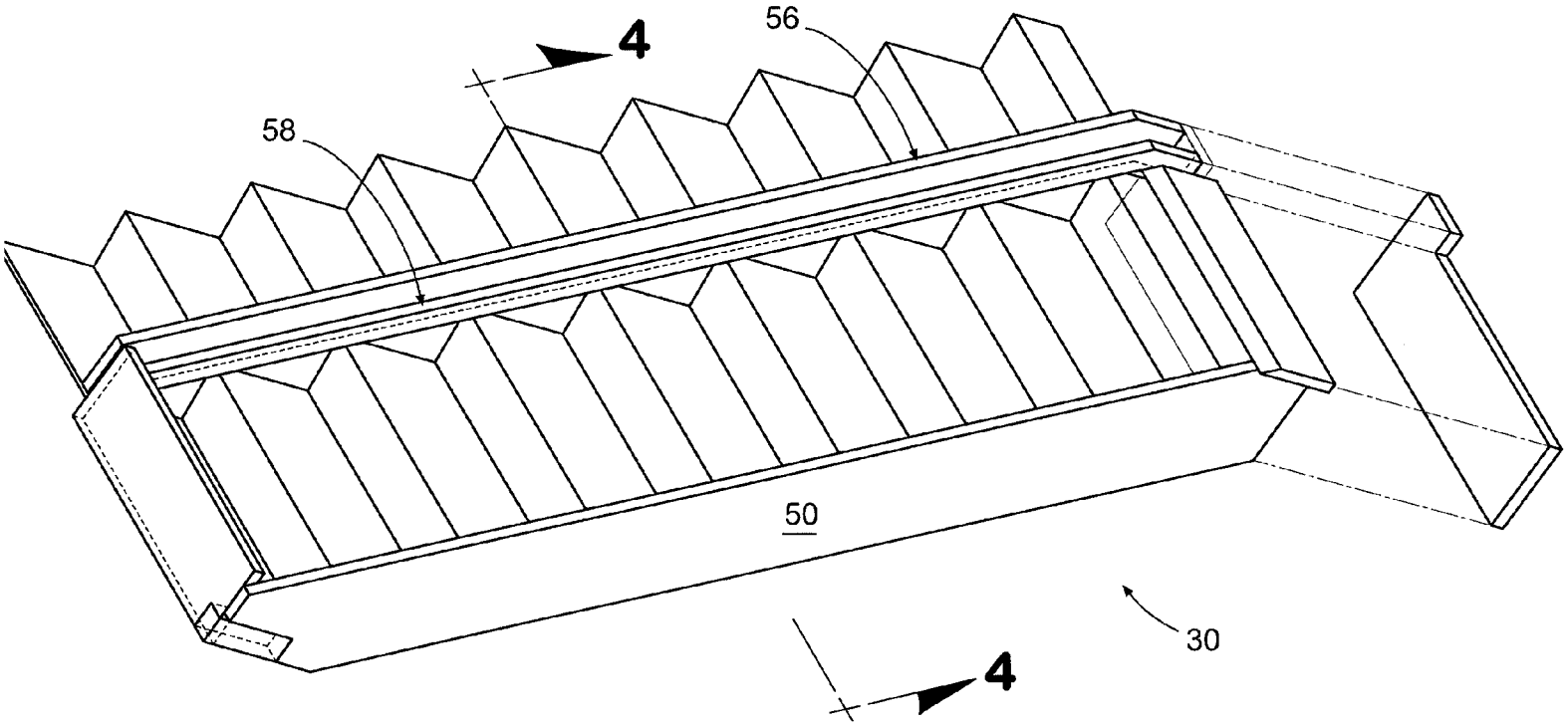
FIG. 3B is a perspective view from the top of the mold of FIG. 3A showing the sides and ends of the mold in position for casting a stair.
Figure 3C:
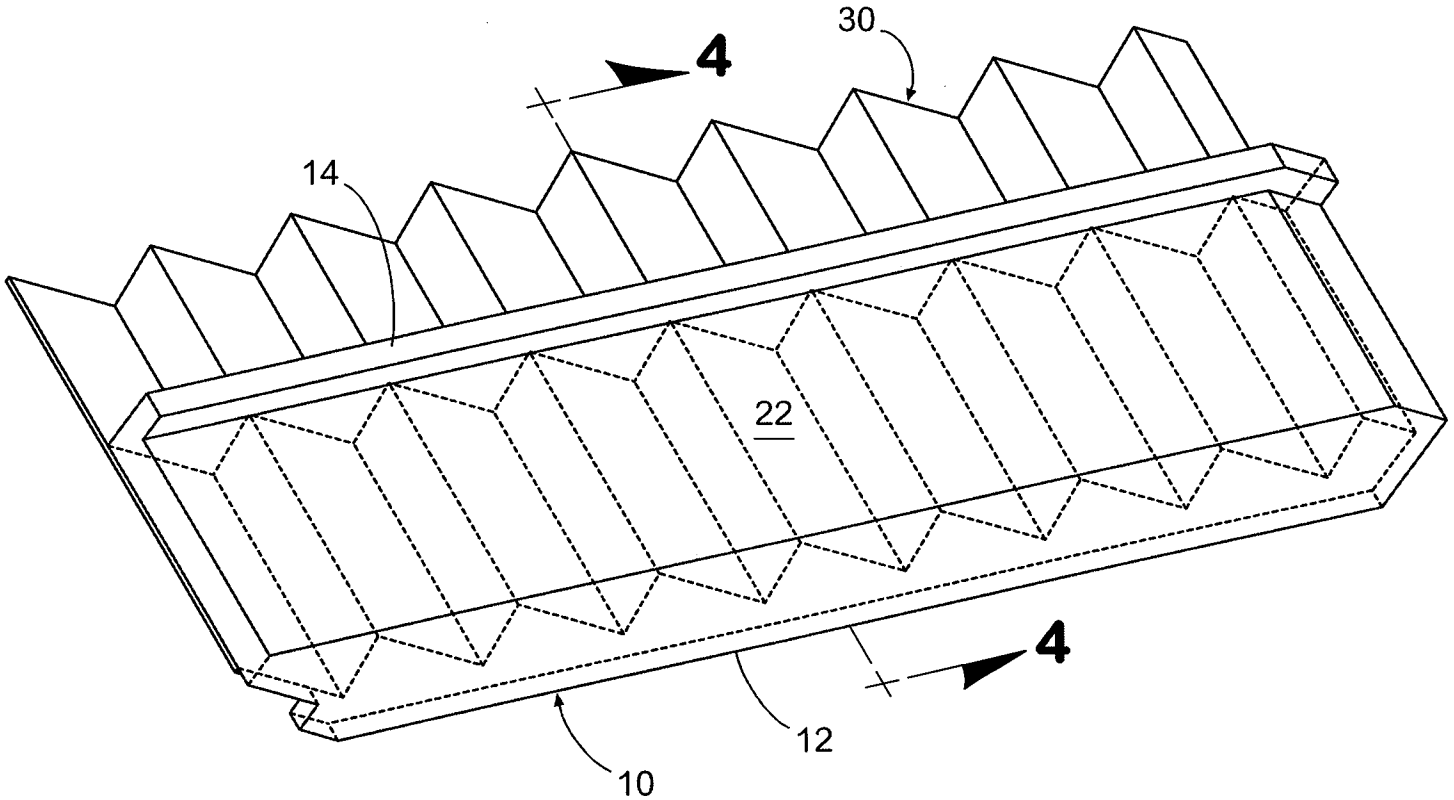
FIG. 3C is a perspective view from the top of the mold of FIG. 3A showing the concrete stair having been formed and the sides and ends of the mold having been removed.
Figure 4:
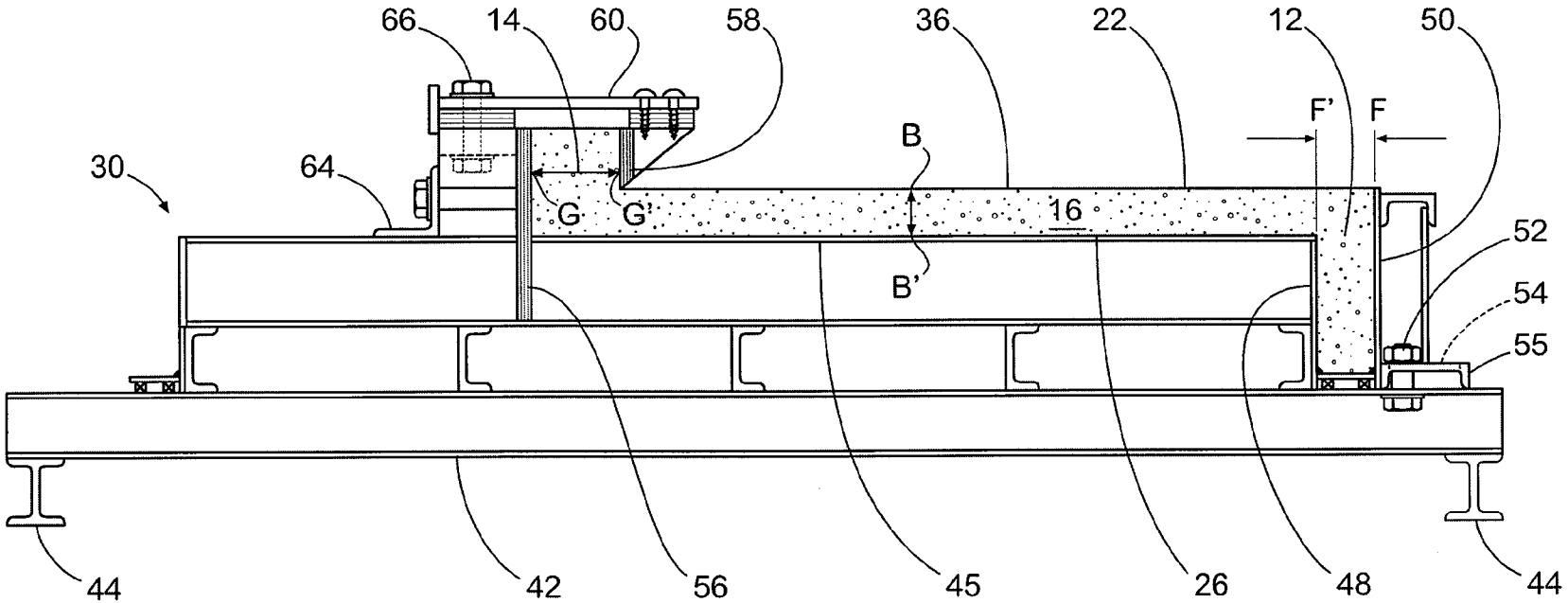
FIG. 4 is a cross-section view taken along line 4-4' of the mold shown in FIGS. 3B and 3C through the width of a step of the stair showing the cross-section of the minimum depth of the step.

The tremendous savings in concrete in forming the individual steps, illustrated by the numeral 28, of the stair 10 of this invention can be shown by examining FIGS. 3 and 4, which show the adjustable mold 30 of this invention. FIGS. 3A and 3B show the various adjustable walls 50, 56, and 58 of the mold 30. FIG. 3C shows the adjustable mold 30 filled with concrete to form a stair 10. Line 4-4$^1$ is taken through the "throat" of the stair 10; the cross-section along line 4-4$^1$ is shown in detail in FIG. 4. The throat of the stair is located at the intersection of the tread 16 and the riser 20, and is where the depth of the concrete between the top 26 and the bottom 36 (which constitutes part of the underside 22 of the stair 10) of the tread 16 is the least.

The depth of the "throat" of the stair 10 is illustrated by line B-B$^1$ between the underside 22 of the stair 10 and the top 26 of the tread 16 where it meets the riser 20 as illustrated in FIG. 4. The depth of this throat B-B$^1$ as shown FIG. 4 can be short because of the synergistic structural stability and strength provided by the combined integral up edge beam 12 and integral down edge beam 14. In the typical stair 10 for an office or apartment building the throat B-B$^1$ can be as small as three inches. The distance that the integral down edge beam 14 projects below the underside 22 of the stair 10 can be as short as four inches in many situations. This results in the integral down edge beam 14 having a total distance of seven inches. The integral up edge beam 12 may have a depth of approximately 12 inches. By reducing the amount of concrete in the steps 28, the size of the integral up edge beam 12 and integral down edge beam 14 can be further reduced resulting in a further savings of concrete which reduces the weight of stair 10. This makes the transportation and erection of the stair easier.

This stair 10 may be placed directly on the top surface of a landing (not shown) or it may have a load transfer device (not shown), which can be placed in the mold 30 for molding. When the top of the stairs 39 is placed in position the load transfer device can be placed in a support rest in the landing (not shown). A similar load transfer device can be placed at the bottom of the stairs, or the stairs 10 can simply rest on the landing.

Referring again to FIG. 4, a cross section of the pre-casting mold 30 is illustrated. Mold support 42 supports the mold. The mold support 42 is supported by a number of legs 44. The stair 10 is formed upside down in the mold 30, so that the bottom surface of the stair 22 is formed at the top of the mold and the top surface of the stair 26 is formed by the bottom surface of the concrete in the mold 30. The tread mold plate 45 forms the top surface 26 of the tread 16.

Because this mold is reusable can be used to cast stairs of different widths. The mold is preferably constructed from steel. However the same principles for the mold would apply if other materials are used. It has been found that steel is more durable for repeated casting of stairs and for being adjusted to cast stairs of different width. The up edge beam 12 is shown in the mold 30 in FIG. 4 in the process of being cast. It is formed by an inside plate 48 and an adjustable outside mold wall 50. The width of this wall F-F$^1$ can be adjusted by moving the adjustable outside mold wall 50. The adjustment mechanism shown is the use of a nut and bolt 52 with the bolt extending through a slot 54 in wall support 55. Other mechanisms for adjusting the width of the up edge beam 12 may be utilized.

Figure 6:
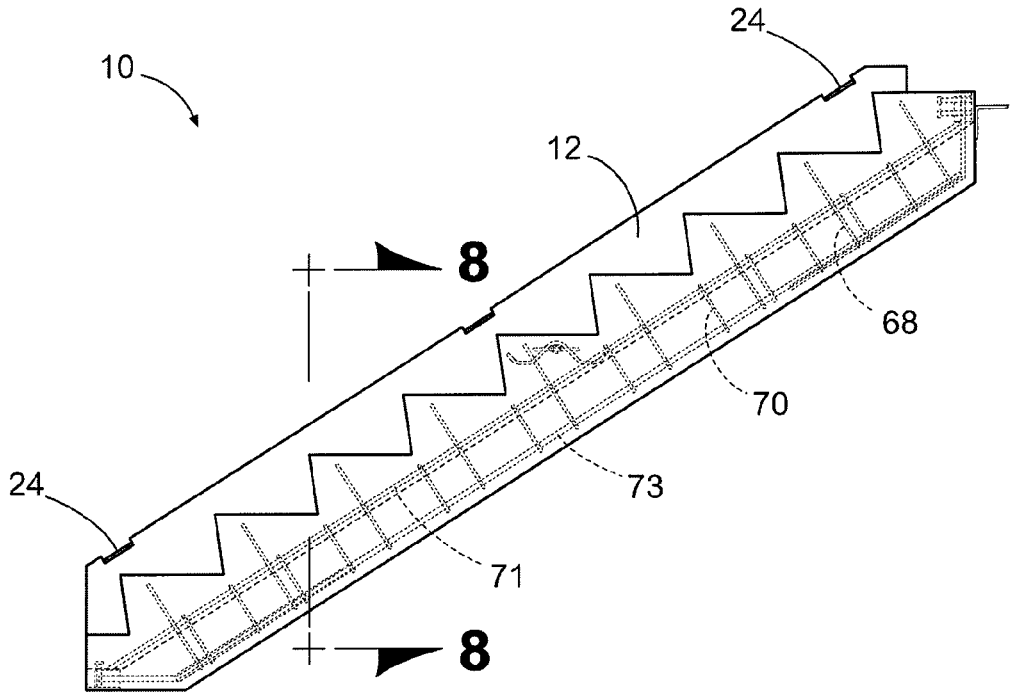
FIG. 6 shows the placement of reinforcement material in a longitudinal cross section of a stair.

The width of the stairs 10 can be adjusted by moving the adjustable outside mold wall 56 for the down edge beam 14. It can be moved either to the right or the left depending on the width of the stairs desired. A number of mechanisms may be used for moving this wall. The means illustrated in FIG. 4 utilizes an adjustable angle iron support 64 for the outside mold wall 56 for the down edge beam 14. This angle iron support 64 can be either welded or bolted or otherwise attached after adjustment. The width G-G$^1$ of the down edge beam 14 can be adjusted by moving the adjustable inside wall 58 for the down edge beam to the right or the left. The height of the down edge beam 14 may also be adjusted by moving upper mold wall 60 up or down; upper mold wall 60 is secured by a bolt 66 to the adjustable outside mold wall 56 and tread mold plate 45. Thus, it can be seen that this mold can be used to mold stairs of different widths by simple adjustments. It is not necessary to build an entirely new mold for each width of stairs. The tread 16 and riser 20 of a step 28 form a zigzag pattern as illustrated in FIG. 6, which is a longitudinal section of the mold of FIGS. 3A-C.

Figure 5:
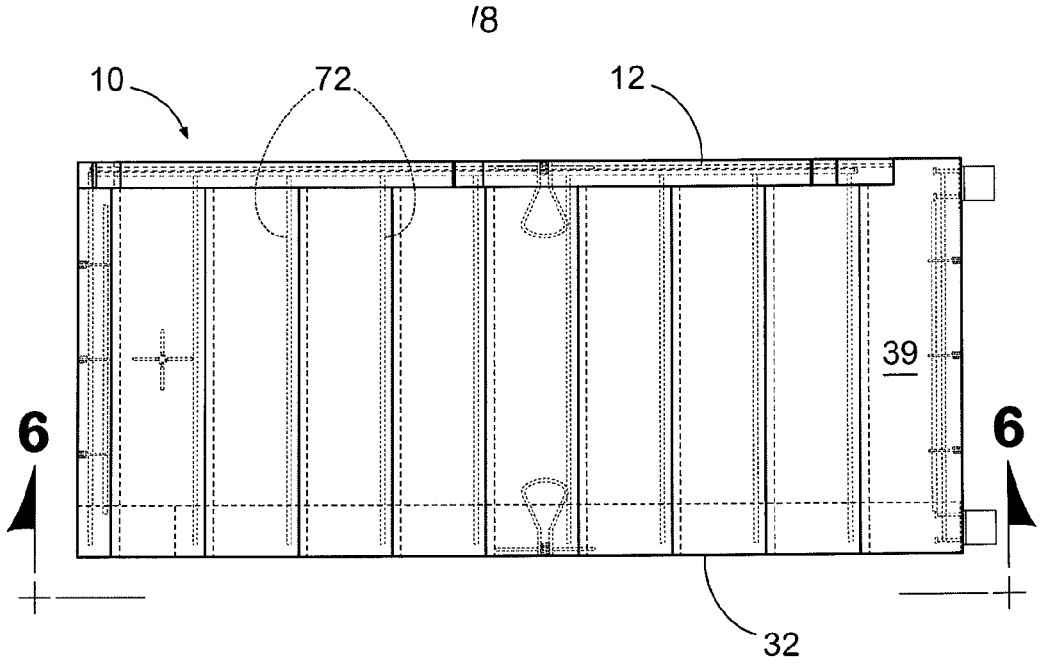
FIG. 5 shows the placement of reinforcement material in a top view of a stair.

These stairs may need to be reinforced. The mechanism for putting in the reinforcement rods reduces the possibility of risks of misplacement in that regard. Reinforcing bars 68 and 70 are shown in FIG. 6. These bars can be placed and held in position by longitudinal bars 71 and 73, to which bars 68 and 70 are secured. It is very important that these bars be placed in proper position or they do not provide the necessary strength to the structure. The longitudinal bars 71 and 73 of the pre-cast mold of the invention reduce the possibility of the bars being misaligned or misplaced. Transverse rods 72 can also be placed in the mold along the width of the stairs in each tread 16 as needed, as shown in the top view of the stair 10 of FIG. 5.

Figure 7:
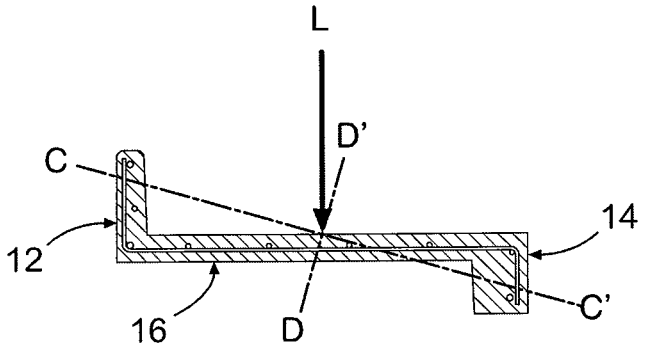
FIG. 7 shows a schematic cross-section of the stair of this invention taken along line 4-4'
Figure 8:
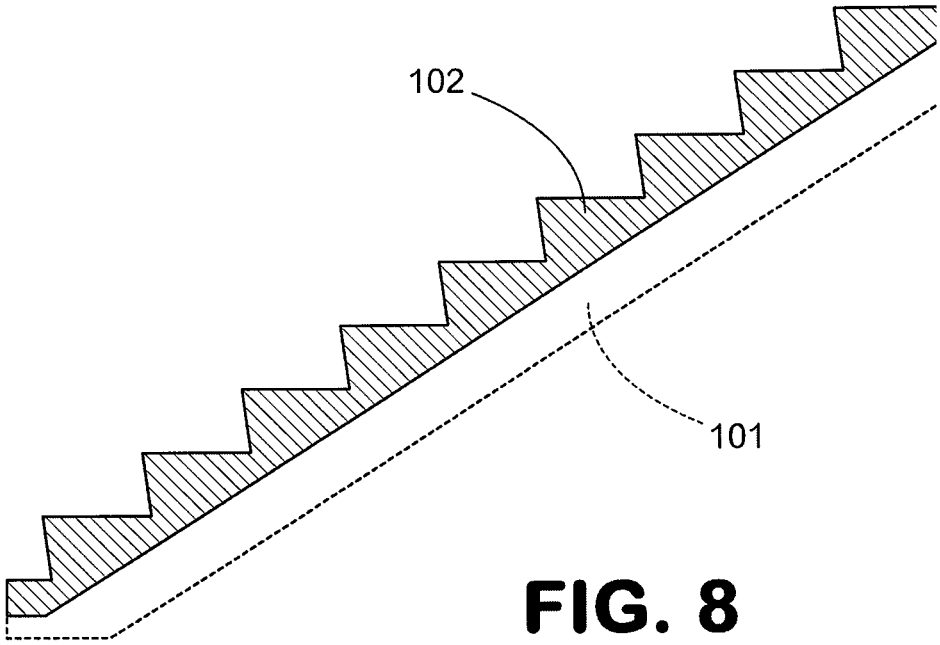
FIG. 8 shows the amount of concrete saved by a stair according to the invention versus a prior art concrete stair.

FIG. 7 is a cross-section of the stair 10 taken through line 4-4' between the top of the riser 20 where it intersects the tread 16 and the underside 22 (bottom of the tread). The load of the stair 10, including the people on the stair, is shown by arrow L. Minor axis C-C' and major axis D-D' illustrate the load on the stair 10 as shown in FIG. 8. The minor axis C-C' extends through the center of depth of the top edge beam 12 and bottom edge beam 14. The angle between load line L and the minor axis C-C' is not normal (i.e. 90 degrees). Integral down edge beam 14 extends below the tread 16 and integral up edge beam 12 projects above the tread 16. Structural rigidity around both the minor axis C-C' and the major axis B-B' creates compression on the tops of the integral down edge beam 14 and integral up edge beam 12, and tension on the bottoms of the integral down edge beam 14 and integral up edge beam 12, which enhances the combined strength of the beams. The asymmetric orientation of the members creates a stronger cross-section than if the beams were in the same plane horizontally. The combined flexural rigidity about the minor axis is 70% greater than the sum of the two sides, giving the up and down edge beam stair 10 superior spanning capability.

The concrete can be poured into the mold and allowed to set to form an integrated monolithic structure. An insert for each tread is placed in the proper position in the mold before pouring the concrete. After the stairs have been molded and cured, they may be removed and installed in a building or a structure. By using the mold and molding process of this invention a lightweight, strong stair can be pre-cast. As these stairs are lifted into place by cranes the weight saved by these stairs not only results in a tremendous reduction in the amount of concrete used but also makes it easier to lift the stair by a crane, and increases the height at which pre-cast stairs may be used. In mid or high rise buildings, pre-cast stairs are currently not an option because of the weight of prior art pre-cast stairs. When concrete stairs are required, due to the owner's preference, fire code, or building code requirements, only cast-in-place stairs, which are highly labor intensive, are currently available.

Figure 1B:
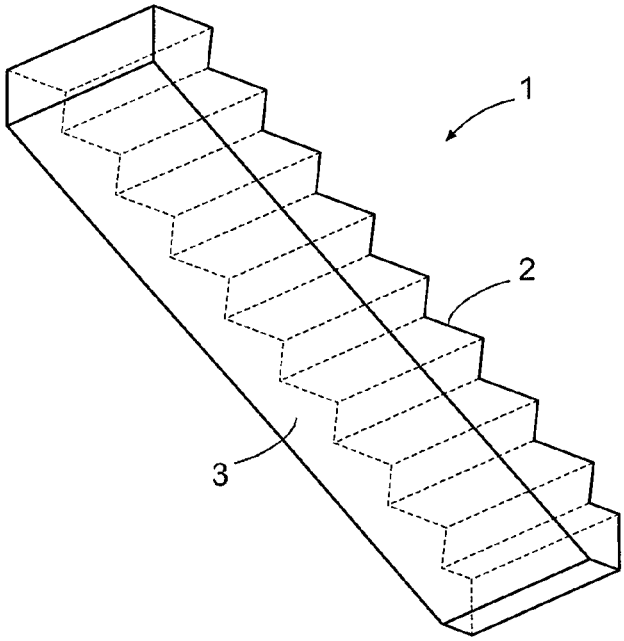
(PRIOR ART) FIG. 1B
FIG. 1B is a perspective view of the prior art stair of FIG. 1A showing the underside of the stair.

FIG. 8 shows the amount of concrete needed for a prior art stair of FIGS. 1A and 1B versus a stair according to the invention, as in FIGS. 2A and 2B. The prior art stair requires concrete 102, plus extra concrete 101. The stair according to the invention only requires concrete 102.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What we claimed is:

1. A stair comprising first and second beams and a plurality of steps formed by a tread and a riser, wherein the steps have an upper side formed by a top of the tread and a front of the riser, and a flat underside, wherein the steps are suspended between and abutting the first and second beams, wherein the stair is an integral, monolithic structure of pre-cast concrete, wherein the first beam has a top, which is coextensive with the upper side of the steps and a bottom, which projects below the underside of the steps, and wherein the second beam has a top, which projects above the upper side of the steps.

2. The stair according to claim 1, wherein the bottom of the first beam projects below the underside of the steps a distance of 4 inches or more.

3. The stair according to claim 1, wherein the concrete is reinforced with a reinforcing material.

4. The stair according to claim 2, wherein the reinforcement material is selected from the group consisting of steel rods and bars.

5. The stair according to claim 1, further comprising a handrail attached to the top of the second beam.

6. The stair according to claim 1, wherein the second beam has a bottom, which is coextensive with the underside of the steps.

* * * * *